US005927405A

United States Patent [19]

Monjure et al.

[11] Patent Number: 5,927,405

[45] Date of Patent: Jul. 27, 1999

[54] CASING ANNULUS REMEDIATION SYSTEM

[75] Inventors: Noel A. Monjure, Houston, Tex.; Kenneth Sikes, Sr., Marrero, La.; David D. Comeaux, Sugarland, Tex.; Francis R. Bobbie, Houston, Tex.; R. Lewis Ropp, New Orleans, La.

[73] Assignee: Abb Vetco Gray, Inc.

[21] Appl. No.: 09/078,230

[22] Filed: May 13, 1998

Related U.S. Application Data

[60] Provisional application No. 60/049,539, Jun. 13, 1997.

[51] Int. Cl.[6] ..... E21B 17/20; E21B 19/22; E21B 21/00

[52] U.S. Cl. ..... 166/384; 166/77.2; 166/90.1; 166/242.2; 166/317

[58] Field of Search ..... 166/242.1, 242.2, 166/384, 385, 381, 317, 50, 90.1, 97.5, 77.1, 77.2, 77.3, 277

[56] References Cited

U.S. PATENT DOCUMENTS

| | | | |
|---|---|---|---|
| 4,754,810 | 7/1988 | Bennett et al. | 166/277 |
| 4,844,166 | 7/1989 | Going, III et al. | 166/379 |
| 4,972,904 | 11/1990 | Godare . | |
| 5,018,583 | 5/1991 | Williams | 166/384 |
| 5,172,765 | 12/1992 | Sas-Jaworsky et al. | 166/384 |
| 5,236,036 | 8/1993 | Ungemach et al. | 166/77.2 |
| 5,284,210 | 2/1994 | Helms et al. | 166/385 |
| 5,348,096 | 9/1994 | Williams | 166/384 |
| 5,511,617 | 4/1996 | Snider et al. | 166/291 |

*Primary Examiner*—Hoang C. Dang
*Attorney, Agent, or Firm*—James E. Bradley

[57] ABSTRACT

A casing annulus remediation system for overcoming problems associated with lowering a flexible hose into an annulus between strings of casing in a petroleum well by pressurizing the hose so that the hose is rigid and may be forced down the annulus. It is necessary to insert the hose through an outlet into the annulus region for brine displacement when pressure builds up in the annulus between casing strings due to leaks in the casing. Pressure build-up in the annulus is reduced by pumping a heavy liquid through the hose into the annular space experiencing the pressure build-up. A nozzle is affixed to the lower end of the hose. The hose may be inserted several hundred feet into the well. Therefore, the hose is pressurized to maintain rigidity to keep the hose from winding about the well during deployment. To keep the hose rigid, internal pressure is maintained in the hose. The nozzle is provided with a burst disk that holds the pressure. Once the hose is lowered to a desired depth, an operator may increase the pressure sufficiently in the hose to break the disk, thereby allowing heavy liquid to flow out. The heavy liquid displaces the lighter well product, which flows out of the outlet. An injection sealer at the surface seals around the hose. A gate valve is employed to shear the hose in the event of an emergency.

18 Claims, 3 Drawing Sheets

CASING ANNULUS REMEDIATION SYSTEM

CROSS-REFERENCE TO RELATED APPLICATIONS

This application claims the benefit of provisional application Ser. No. 60/049,539, filed Jun. 13, 1997.

TECHNICAL FIELD

This invention relates in general to well remediation systems and in particular to the process and components used for filling an annulus in a well with heavy liquid to control pressure build-up in an annulus surrounding leaking casing and/or cement.

BACKGROUND OF THE INVENTION

In wells drilled for petroleum production, a plurality of well casings of different sizes are suspended from a wellhead. A problem encountered in such wells is that of annular pressure control. In the annulus between different casing sizes, pressure may develop due to leaks between strings of casing. Previously, to control the pressure, a relatively heavy liquid is pumped into the annulus at the upper end of the well. The heavy liquid migrates slowly downward, displacing lighter liquid. This technique does not always work.

BRIEF SUMMARY OF THE INVENTION

In this system, a flexible hose is lowered into an annulus between strings of casing. A nozzle is affixed to the lower end of the hose. The hose may be inserted several hundred feet into the well. Therefore, the hose must be pressurized and rigid to keep the hose from winding about the well. To keep the hose rigid, internal pressure is maintained in the hose. The nozzle is provided with a valve or burst disk in it that holds the pressure. Once the hose is lowered to a desired depth, the operator increases the pressure sufficiently in the hose to break the disk or open the valve, thereby allowing heavy liquid to flow out. The heavy liquid displaces the lighter well production, which flows out of the outlet. An injection sealer at the surface seals around the hose. A gate valve is employed to shear the hose in the event of an emergency.

BEST MODE FOR CARRYING OUT THE INVENTION

Figure 1:
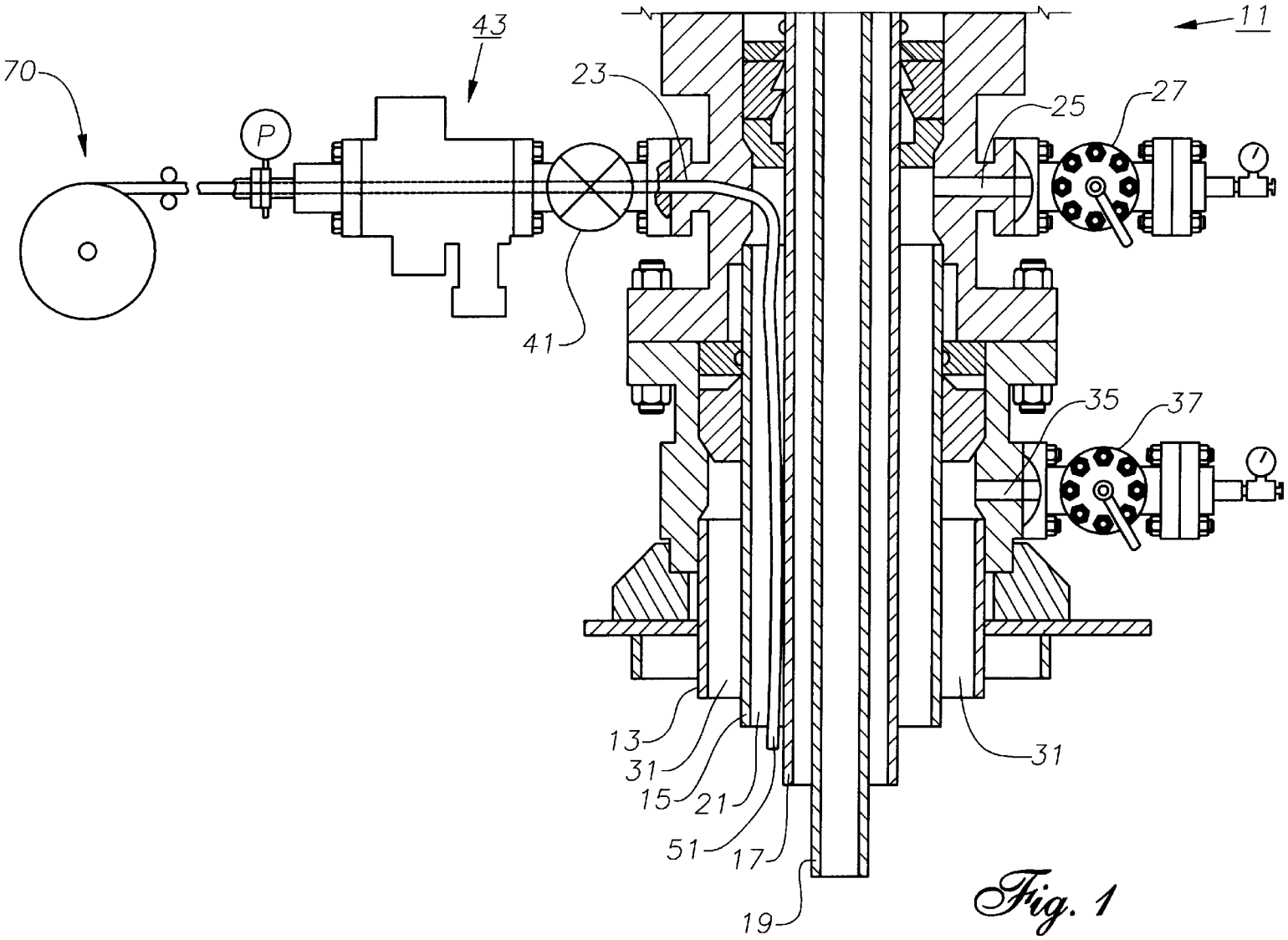
FIG. 1 is a sectional side view of a wellhead constructed in accordance with the invention.

Referring to FIG. 1, a wellhead 11 having multiple strings of casing 13, 15, 17, 19 suspended from it is shown. A longitudinal annulus extends between each pair of adjacent strings of casing. Each annulus has at least one access port at wellhead 11. For example, annulus 21 extends between casing strings 15 and 17, and has access ports 23, 25, while annulus 31 extends between casing strings 13 and 15, and has access port 35. Conventional valves 27 and 37 control flow through ports 25 and 35, respectively.

Figure 2:
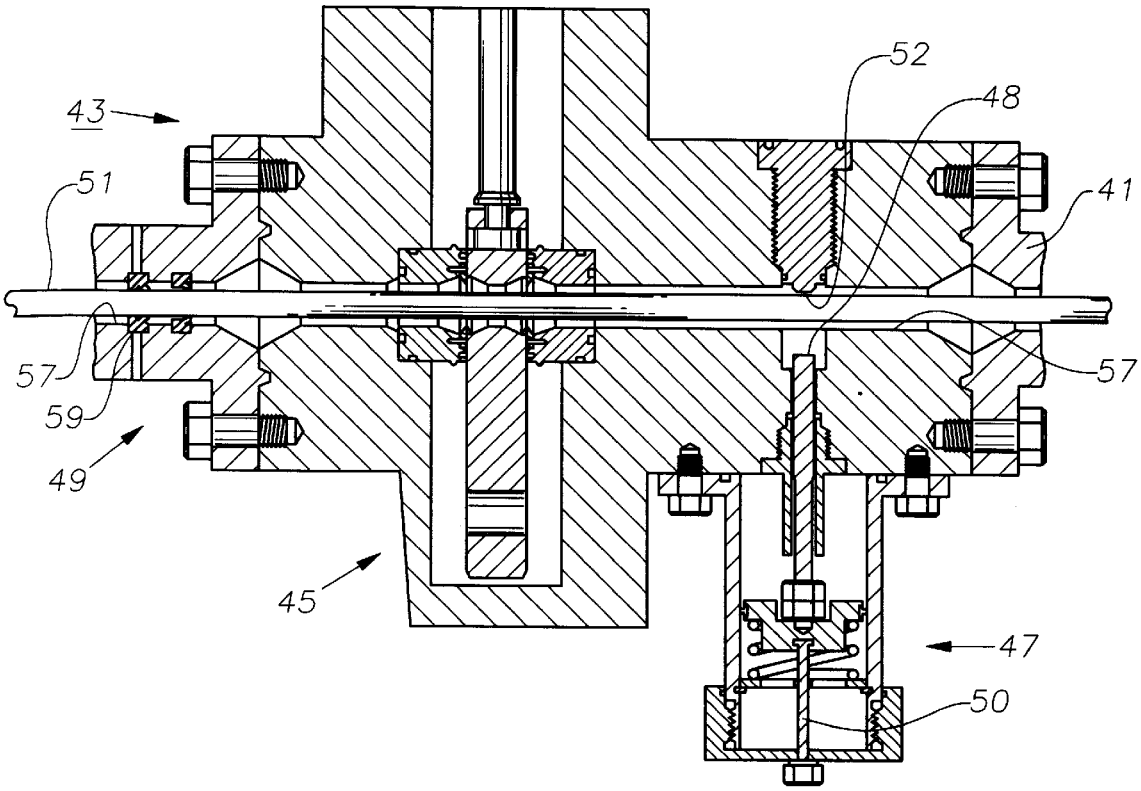
FIG. 2 is a sectional side view of a remediation valve and remediation hose capture assembly secured to the wellhead of FIG. 1.

A gate valve 41 is bolted to the outer surface of wellhead 11 and controls access to port 23. A stuffing box assembly 43 is secured to gate valve 41. As shown in FIG. 2, in this embodiment, stuffing box assembly 43 comprises a remediation valve 45, a pinning device 47, a packoff 49 and an axial passage 57. A flexible elastomeric hose 51 extends through passage 57. In the preferred embodiment, hose 51 comprises a strong polyester braid surrounded by two layers of plastic and has an outer diameter of about one inch. Hose 51 is coiled on a hose driver assembly 70 further upstream from stuffing box assembly 43.

Figure 3:
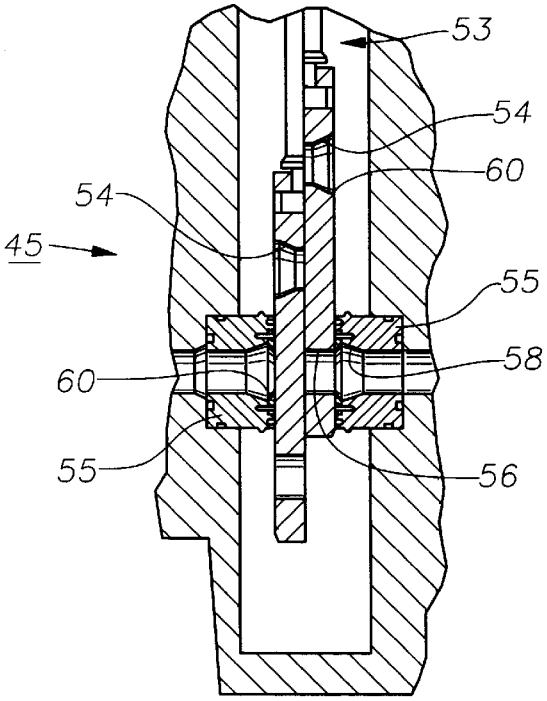
FIG. 3 is an enlarged, split sectional side view of a gate in the remediation valve of FIG. 2 showing a sealing position on the left side and a retrieval position on the right side.

As shown in FIG. 3, remediation valve 45 has a vertically slidable gate 53, and upstream and downstream seats 55 with axial holes 58 which register with passage 57. Gate 53 has two horizontal openings 54, 56 that are approximately the same diameter. Opening 54 and holes 58 have sharpened edges 60 made from tool steel for shearing hose 51 in an emergency. Gate 53 has three possible positions. In the running position (FIG. 2), opening 54 registers with holes 58. In the sealing or fail-safe position, a solid portion of gate 53 seals between seats 55 (left side of FIG. 3). Finally, in the retrieval position, opening 56 registers with holes 58 (right side of FIG. 3).

Returning to FIG. 2, pinning device 47 is located between remediation valve 45 and gate valve 41. Pinning device 47 has a cylindrical rod 48 on the end of a shaft SO. Rod 48 and shaft 50 are vertically moveable between an open position and a closed or pinning position (not shown) wherein hose 51 is clamped between rod 48 and a stop 52. Packoff 49 is a sealing system that is located on the upstream side of remediation valve 45. A conventional injection sealer 59 pumps grease around hose 51 to seal between hose 51 and passage 57.

Figure 4:
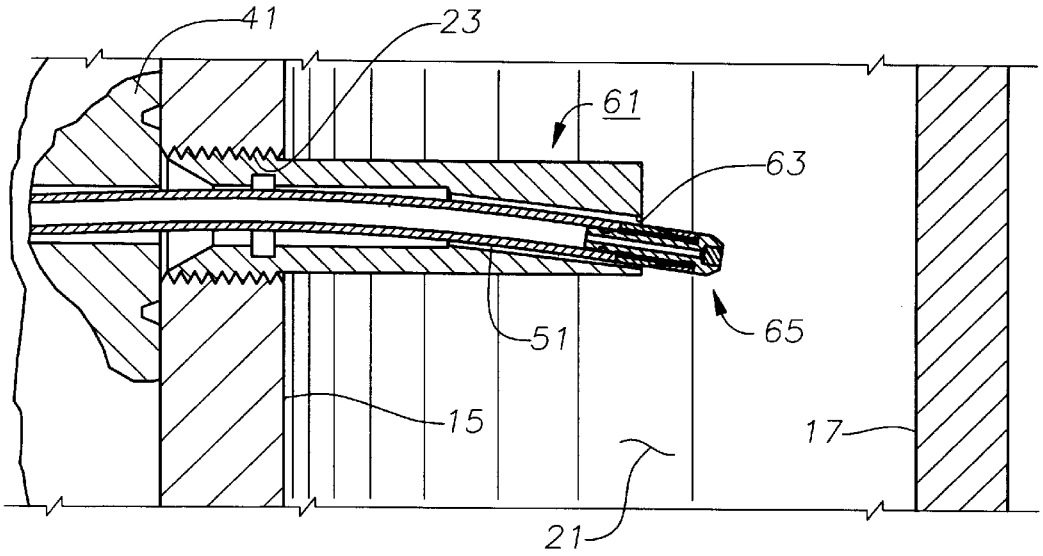
FIG. 4 is an enlarged sectional side view of a hose guide bushing in a port in the wellhead of FIG. 1.
Figure 5:
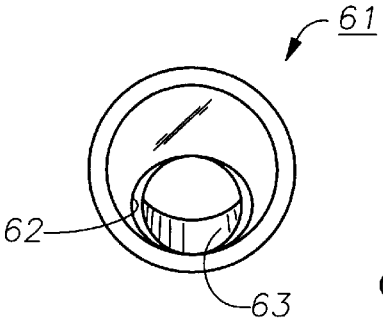
FIG. 5 is an end view of the hose guide bushing of FIG. 4.

Referring to FIGS. 4 and 5, a hose guide bushing 61 is threaded into and extends radially inward from access port 23 into wellhead 11. Hose guide bushing 61 has a passage 63 which communicates with passage 57 through gate valve 41. A radially inward portion of passage 63 is skewed downward at an obtuse angle relative to the outer portion of passage 63 into wellhead 11. A chamfer 62 is ground into passage 63 at the radially inward end of bushing 61. Chamfer 62 is elliptical and has a greater horizontal width than vertical height. Hose 51 is inserted from the hose driver assembly 70, through passage 57 and gate valve 41, and into passage 63.

Figure 6:
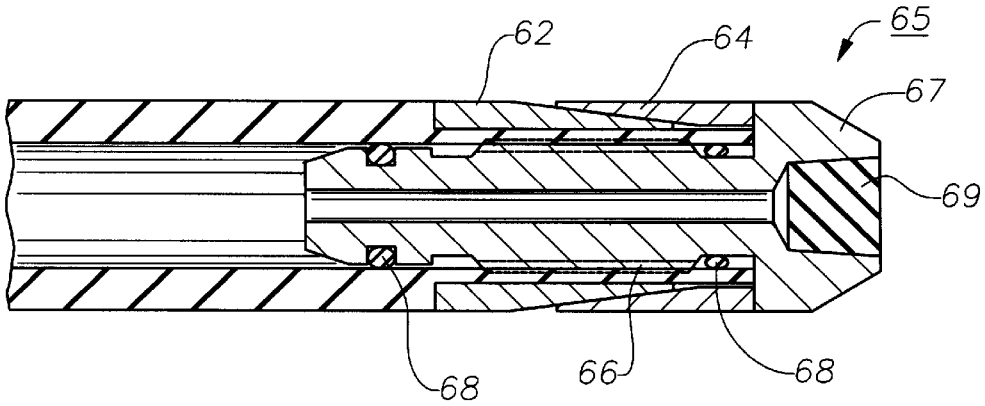
FIG. 6 is an enlarged sectional side view of a hose and nozzle.

As shown in FIG. 6, one end of hose 51 has a cylindrical tubing nose assembly 65 with self-tapping threads 66 fastened to one end. The diameter of hose 51 is reduced a small amount on the end where tubing nose 65 attaches. This reduction allows tubing nose 65 to have the same final outer diameter as hose 51. As tubing nose 65 is threaded into hose 51, ring 64*a* and wedges 64*b* crush hose 51 into threads 66. A pair of O-rings 68 provide the necessary seal. Tubing nose 65 has a tapered tip 67 that is designed to assist the movement of hose 51 through the components of wellhead 11 and annulus 21. Tubing nose 65 also has a small plastic burst disc, plug, or cap 69 that opens by being blown out, rupturing under a selected pressure or opening by some other means. Cap 69 serves as a pressure retaining mechanism to hold pressure in hose 51 until a selected pressure is revealed.

In operation, if one of the strings of casing 13, 15, 17, or 19 begins to leak, a pressure build-up may occur in the annulus between the strings of casing. In this invention, pressure build-up is alleviated by pumping a heavy liquid into that annular space and displacing well fluid. If casing 17 is leaking, the heavy liquid is delivered to the annulus through hose 51, which is run through passages 57, 63 (FIGS. 2 and 4). Hose 51 is pressurized with the heavy liquid to sufficient pressure (approximately 100 psi) to make it substantially rigid. Hose 51 will be pushed into stuffing box assembly 43 and port 23 with gate 53 in the running position (FIG. 2). Although hose 51 is fairly rigid, hose guide bushing 61 steers hose 51 and tubing nose 65 slightly downward into annulus 21 (FIG. 4). Tip 67 of tubing nose 65 will glance off casing 17, and hose 51 is forced downward into annulus 21 (not shown). Chamfer 62 allows hose 51 some horizontal movement and prevents hose 51 from wedging between casing 17 and bushing 61. The hose driver assembly continues feeding hose 51 into annulus 21. Because of its rigidity, hose 51 may extend several hundred feet into annulus 21 without winding about the annulus (not shown). In an alternate embodiment, a fluid jet may be directed up to enhance the downward travel of the hose.

Once hose 51 and tubing nose 65 are at the correct depth, the pressure in hose 51 is sufficiently increased to burst cap 69, allowing the heavy fluid to flow out through tubing nose 65. The heavy liquid displaces the lighter well production fluid which flows out port 25 when valve 27 is opened (FIG. 1). Once the heavy liquid fills annulus 21, hose 51 is removed and the valves are closed.

If packoff 49 is unable to prevent leakage around hose 51 due to high pressure in the well getting out of control or some other emergency occurs, pinning device 47 is used to pin hose 51 with rod 48 and stop 52. Gate 53 is then moved to the sealing position and hose 51 is sheared by edges 60 in a scissoring motion. It is important to have a clean cut so that hose 51 can be plugged with a fishing tool and retrieved later after the pressure is under control. After the pressure in the well is under control, gate 53 is moved to the retrieval position with hole 56 aligning with seat holes 58. A tool is run in through hole 57 to grip the cut end of hose 51. Pinning device 47 is then released and the remaining length of hose 51 is retrieved. In the final step, gate 53 is moved back to the running position so that the small piece of cut hose 51 still lodged in opening 54 may be removed with the tool. This operation could be performed on any annulus in wellhead 11.

The invention has significant advantages. By pressurizing small diameter elastomeric tubing, inexpensive elastomeric tubing may be used instead of large and expensive coiled tubing to inject fluids in a well annulus. The tubing may be used to run an inspection camera. Additionally, the tube may be left in the well to be used for casing annulus pressure remediation and annulus pressure remediation or periodically unloading the well, pumping chemicals, etc.

While the invention has been shown in only one of its forms, it should be apparent to those skilled in the art that it is not so limited, but is susceptible to various changes without departing from the scope of the invention.

We claim:

1. An apparatus for insertion into a well to displace well fluid, said well having a wellhead with a longitudinal axis, a lateral port which is substantially perpendicular to the axis, at least one string of casing supported in said wellhead and extending past said lateral port into said well, defining an annulus, said apparatus comprising:

a flexible, elastomeric hose;

a nozzle having a closure mechanism on a lower end of said hose which is capable of holding a pressure to make said hose rigid, enabling said hose to be pushed down said annulus, said closure mechanism being opened by increasing pressure in said hose to subsequently allow a remediation fluid to be pumped through said hose;

said hose being sufficiently flexible and said nozzle being sufficiently short so that said hose may be pushed through said lateral port and deflected downward into said annulus when contacting said casing; and a pump connected to said hose for pressurizing said hose and delivering said remediation fluid.

2. An apparatus according to claim 1 further comprising:

a hose guide bushing adapted to be affixed to an access port in said wellhead, wherein said hose guide bushing defines a downwardly skewed passage for directing said hose down said well.

3. An apparatus according to claim 2 wherein said hose guide bushing has a chamfered opening to permit some horizontal movement of said hose relative to said guide bushing.

4. An apparatus according to claim 1 wherein said closure mechanism comprises:

a tubing nose at a terminal end of said flexible hose; and a plug in said tubing nose for plugging said flexible hose to allow pressure to cause the hose to become rigid to facilitate insertion, and wherein said plug releases at a selected pressure to allow remediation liquid to be delivered through said hose into said well.

5. The apparatus of claim 1, further comprising a housing mounted to said lateral port and having a packoff for sealing around said hose as said hose is being pushed into said annulus.

6. In a well having a wellhead having an axis, at least one lateral port which is substantially perpendicular to the axis, and at least one casing string supported in said wellhead and extending past said lateral port into the well, defining a casing annulus surrounding said casing which is in communication with said lateral port, wherein the casing annulus contains a well fluid due to leakage into the casing annulus, the improvement comprising:

a flexible elastomeric hose passing through said lateral port into contact with a portion of said casing adjacent to said lateral port, and redirected down said annulus to a selected depth;

a nozzle on the hose which has a closure mechanism which is capable of holding a pressure to make said hose rigid, enabling said hose to be pushed down said annulus, said closure mechanism being opened by increasing pressure in said hose; and a pump operatively engaged with said flexible hose for applying pressure to said hose and for delivering a remediation liquid through said hose while said closure mechanism is open to displace the well fluid in said casing annulus and prevent leakage.

7. The well according to claim 6 further comprising:

a hose guide bushing affixed to said access port in said casing annulus, wherein said hose guide bushing defines a downwardly skewed passage for directing said hose down said annulus.

8. A well according to claim 7 wherein said hose guide bushing has a chamfered opening which has a greater horizontal dimension than vertical dimension to permit some horizontal movement of said hose relative to said guide bushing.

9. The well according to claim 6 further comprising:

a tubing nose at a terminal end of said flexible hose; and a plug in said tubing nose for plugging said flexible hose to allow pressure to cause the hose to become rigid to facilitate insertion, and wherein said plug releases at a selected pressure to allow said remediation liquid to be delivered.

10. The well of claim 6 further comprising a housing mounted to said lateral port and having a packoff for sealing around said hose as said hose is being pushed into said annulus.

11. A method of installing a conduit into a well having a wellhead with a longitudinal axis, at least one string of casing extending downward from the wellhead, an annulus surrounding the casing, and a lateral port in the wellhead which is substantially perpendicular to the axis and communicates with said annulus, comprising the steps of:

(a) passing a flexible hose having a closed lower end through said lateral port, causing said lower end to contact said casing across from said lateral port and deflect said hose downward into said annulus;

(b) pressurizing said hose to a first pressure to make said hose substantially rigid; and (c) continuing to push said hose downward in said annulus to a selected depth; then (d) opening said lower end of said hose when said lower end is at a desired depth; and (e) flowing fluid out of said lower end of said hose.

12. The method of according to claim 11 wherein:

step (b) comprises placing a plug in said lower end; and step (d) comprises increasing said first pressure sufficiently to remove said plug.

13. The method according to claim 12 wherein said well has at least two tubular conduits, defining an annulus between them and wherein steps (a) and (b) comprise inserting and pushing said hose down said annulus.

14. The method according to claim 11 wherein step (e) comprises pumping fluid from the surface through said hose and displacing well fluid from said annulus out an outlet port provided in said wellhead.

15. The method according to claim 11 wherein step (e) comprises pumping fluid from the surface through said hose and displacing well fluid from said well out an outlet port provided in said wellhead, wherein said pumped fluid is heavier than said well fluid in the well.

16. The method according to claim 12 wherein said well has at least two tubular conduits, defining an annulus between them, and wherein steps (a) and (b) comprise inserting and pushing the hose down the annulus and wherein step (e) comprises pumping fluid from the surface through said hose and displacing well fluid from said well out the upper end of the well, said pumped fluid being heavier than said well fluid in the well.

17. The method according to claim 12 wherein said well has a wellhead with a tubular bore, a string of casing suspended in said bore, defining a casing annulus surrounding said casing, an access port extending through said wellhead and in communication with said annulus, and wherein steps (a) and (b) comprise inserting and pushing said hose down said annulus.

18. The method of claim 11 wherein step (d) comprises increasing the pressure in said hose to an amount greater than said first pressure to cause said lower end to open.

* * * * *

UNITED STATES PATENT AND TRADEMARK OFFICE

CERTIFICATE OF CORRECTION

PATENT NO. : 5,927,405

DATED : July 27, 1999

INVENTOR(S) : Noel A. Monjure, et. al.

It is certified that error appears in the above-identified patent and that said Letters Patent is hereby corrected as shown below:

Title page, item [73] Assignee: should read --ABB Vetco Gray, Inc.--

Column 2, line 32, "SO" should be --50--.

Signed and Sealed this

Eighth Day of February, 2000

*Attest:*

*Attesting Officer*

Q. TODD DICKINSON

*Commissioner of Patents and Trademarks*